United States Patent [19]

Fohl et al.

[11] Patent Number: 4,786,841

[45] Date of Patent: Nov. 22, 1988

[54] LOW-PRESSURE ARC DISCHARGE LAMP HAVING INCREASED SURFACE BRIGHTNESS

[75] Inventors: Timothy Fohl, Carlisle; Robert Y. Pai, Hamilton; Warren C. Gungle, Danvers, all of Mass.

[73] Assignee: GTE Products Corporation, Danvers, Mass.

[21] Appl. No.: 64,961

[22] Filed: Jun. 22, 1987

[51] Int. Cl.[4] ..... H01J 61/30; H01J 63/04

[52] U.S. Cl. ..... 313/493; 313/488; 313/489; 313/610; 313/611

[58] Field of Search ..... 313/488, 489, 493, 573, 313/634, 609, 610, 611, 635, 636

[56] References Cited

U.S. PATENT DOCUMENTS

| | | | |
|---|---|---|---|
| 2,068,595 | 1/1937 | Burns | 313/611 |
| 2,965,778 | 12/1960 | Jenkins et al. | 313/573 |
| 3,599,029 | 8/1971 | Martyny | 313/573 X |
| 3,848,150 | 11/1974 | Taxil et al. | 313/610 X |
| 3,988,633 | 10/1976 | Shurgan et al. | 313/493 |
| 4,255,687 | 3/1981 | Van Engelen | 313/488 |
| 4,289,991 | 9/1981 | Schreurs | 313/493 X |
| 4,374,340 | 2/1983 | Bouwknegt et al. | 313/493 |
| 4,426,602 | 1/1984 | Mollet et al. | 313/493 |
| 4,559,480 | 12/1985 | Nobs | 315/169.4 |

FOREIGN PATENT DOCUMENTS

| | | | |
|---|---|---|---|
| 91546 | 5/1985 | Japan | 313/488 |
| 397162 | 9/1933 | United Kingdom . | |

*Primary Examiner*—David K. Moore
*Assistant Examiner*—Michael Horabik
*Attorney, Agent, or Firm*—Carlo S. Bessone

[57] ABSTRACT

An arc discharge lamp having a sealed envelope including a major body portion and at least one minor transverse end portion. A non-specular light diffusing surface is axially located between the minor transverse end portion and one of the lamp electrodes. A phosphor layer within the sealed envelope subtends the major body portion of the envelope. The surface brightness of the phosphor layer as viewed through the minor transverse end portion of the envelope is greater than the intensity of the external surface brightness of the phosphor layer on the major body portion of the envelope during operation of the lamp. A lamp array for use as an element in a picture display is also disclosed including a plurality of sealed envelopes. In the case of a color presentation of information, one picture element is composed of three sealed envelopes phosphor coated with the primary colors red, green and blue.

16 Claims, 4 Drawing Sheets

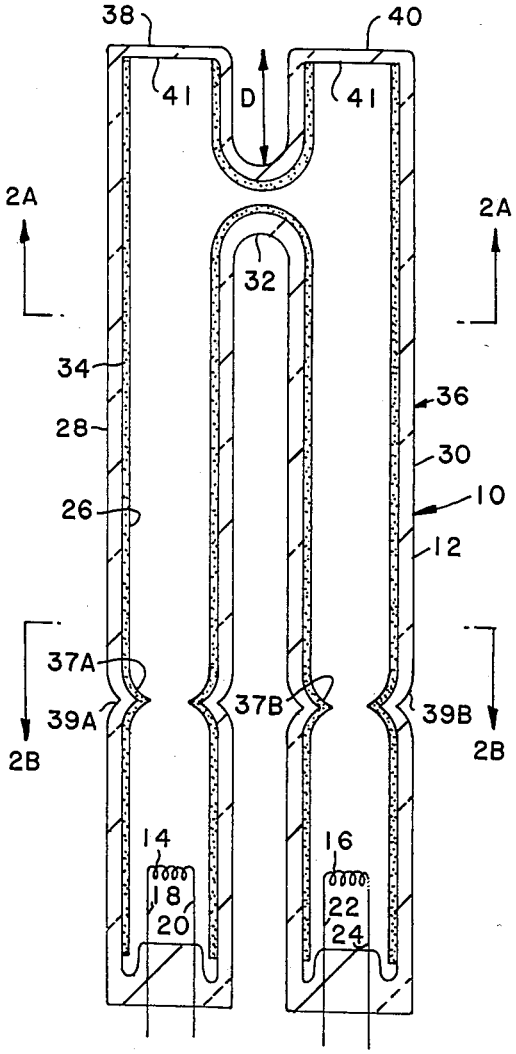
FIG. 1
FIG. 2A
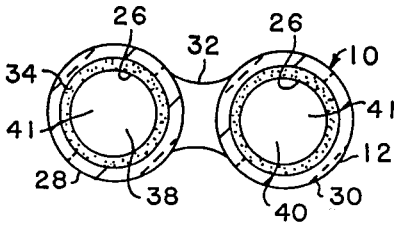
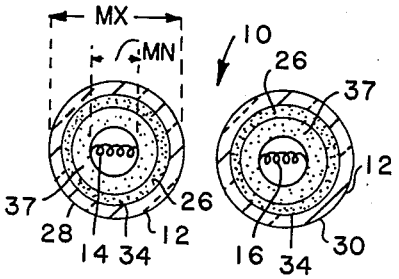
FIG. 2B

LOW-PRESSURE ARC DISCHARGE LAMP HAVING INCREASED SURFACE BRIGHTNESS

CROSS REFERENCE TO OTHER APPLICATIONS

This application discloses, but does not claim, inventions which are claimed in U.S. Ser. Nos. 64,978 and 64,731 filed concurrently herewith and assigned to the Assignee of this application.

TECHNICAL FIELD

This invention relates to low-pressure arc discharge lamps and more particularly to such lamps adaptable for use both as an element in a picture display and in certain general illuminating applications wherein a considerable portion of the light emitted from the lamp is directed in a particular direction.

BACKGROUND OF THE INVENTION

Low-pressure arc discharge lamps have been used for optical presentation of information, i.e., presentation of alpha numeric signs, graphics and pictures displayed on a screen or display, respectively. Such a display consists of a matrix of picture elements, each picture element consisting of a monochrome light signal source in the case of a monochrome display. In the case of a color presentation of information, one picture element is composed on three single lamps of the primary colors red, green and blue. The desired color impression is then created physiologically by additive mixture of the three primary colors within the human eye/brain system.

There have been proposed a wide variety of flourescent lamps of such special configuration as to be applicable to such displays. For example, FIG. 1 of UK patent application No. GB 2 145 873 A, published on Apr. 3, 1985, shows one typical lamp which comprises a phosphor-coated tubular envelope of convoluted tridimensional configuration that contains a pair of electrodes and an ionizable medium. For construction of the color display, a multiplicity of the above flourescent lamps are arranged in a matrix so as to form one picture element by the combination of three lamps having the envelope coated with respective phosphors emitting the different primary colors, i.e., red, green and blue. Although the known lamps operate satisfactorily when used in some of such displays, drawbacks still exist.

Presenting information to a large audience in the open air means looking for a correspondingly larger area display which is distinctly visible not only at night but also during daylight and with sufficient optical resolution from a greater viewing distance. In the above known lamps, only the curved portion of the U-shaped envelope is presented towards the audience so that no more than approximately 20 percent of radiation is effective. The rest is dissipating, especially through the parallel legs of the U-shaped envelope which are arranged parallel to the longitudinal axis of the lamp and substantially normal or perpendicular, respectively, to the plane of fixation of a unit, said plane being also substantially normal to the viewing direction of the spectators. The surface brightness along the envelope is substantially constant, i.e., one area along the envelope does not appear brighter than another area.

Other low-pressure arc discharge flourescent lamps primarily used for general illumination are known in which the envelope includes at least two longitudinally extending leg members joined together by a transversely extending envelope portion. Examples of such lamps which are commercially available are the "Twin Tube" and "Double Twin Tube" flourescent lamps manufactured by GTE Sylvania, Danvers, Mass. Other examples are disclosed in U.S. Pat. No. 4,374,340, which issued to Bouwknegt et al on Feb. 15, 1983; U.S. Pat. No. 4,426,602, which issued to Mollet et al on Jan. 17, 1984; and U.S. Pat. No. 4,481,442, which issued to Albrecht et al on Nov. 6, 1984. Lamps described in the above-mentioned U.S. Patents allow most of the radiation to be dissipated through the longitudinally extending leg members. The surface brightness along the envelope is also substantially constant.

BRIEF SUMMARY OF THE INVENTION

It is, therefore, an object of this invention to obviate the disadvantages of the prior art.

It is still another object of the invention to provide an improved arc discharge lamp adaptable for use both as a picture element in a picture display and in certain general illuminating applications wherein the surface brightness viewed through a portion of the lamp envelope substantially transverse to an imaginary line parallel to the longitudinal axis is of a greater intensity than the surface brightness of the phosphor on a longitudinally extending portion of the envelope.

These objects are accomplished in one aspect of the invention by the provision of an arc discharge lamp having a longitudinal axis comprising a sealed envelope having a longitudinal configuration and including a major body portion and at least one minor transverse end portion. A pair of electrodes are spacedly located within the envelope for generating an arc discharge therebetween during operation of the lamp. An ionizable medium is contained within the envelope. A phosphor layer is disposed on the internal surface of the major body portion of the envelope and not disposed on the internal surface of at least a part of the minor transverse end portion of the envelope. A non-specular light diffusing surface is within the envelope axially located between the minor transverse end portion and one of the electrodes. The non-specular light diffusing surface extends in a direction transverse to an imaginary line parallel to the longitudinal axis. The internal surface brightness of the non-specular light diffusing surface as viewed through the part of the minor transverse end portion of the envelope is of greater intensity than the external surface brightness of the phosphor layer on the major body portion of the envelope during operation of the lamp. The non-specular light diffusing surface can be, for example, phosphor, titanium dioxide or aluminum oxide.

In accordance with further teachings of the present invention, a reflector layer is disposed on the internal surface of the major body portion of the envelope and not disposed on the internal surface of at least a part of the minor transverse end portion of the envelope. A phosphor layer is disposed on the reflector layer. A non-specular light diffusing surface is within the envelope axially located between the minor transverse end portion and one of the electrodes. The non-specular light diffusing surface extends in a direction transverse to an imaginary line parallel to the longitudinal axis. The surface brightness of the phosphor layer as viewed through the minor transverse end portion of the envelope is of greater intensity than the external surface brightness of the phosphor layer on the major body portion of the envelope during operation of the lamp. In one embodiment according to the invention, the phosphor layer is disposed both on the reflector layer and the internal surface of a part of the minor transverse end portion of the envelope.

In accordance with further teachings of the present invention, the envelope includes at least first and second longitudinally extending leg members and a transversely extending envelope portion joining the first and second leg members to form a continuous passage therethrough for the arc discharge. In one preferred embodiment, the arc discharge lamp includes first and second minor transverse end portions associated respectively with the first and second longitudinally extending leg members. At least a part of the first minor transverse end portion does not have a phosphor layer disposed on the internal surface thereof. The first longitudinally extending leg member has a single constriction associated therewith extending substantially about the circular periphery of the envelope and projection therein with the non-specular light diffusing surface being located on the constriction. Preferably, the ratio of the maximum internal diameter of the envelope to the minimum internal diameter of the constriction is within the range of from about 2:1 to about 4:1.

In accordance with further aspects of the present invention, the first longitudinally extending leg member has a single partition associated therewith whereon said non-specular light diffusing surface is located. Preferably, the partition lies in a plane substantially perpendicular to the longitudinal axis of the lamp.

In accordance with still further aspects of the present invention there is taught an arc discharge lamp array comprising a plurality of sealed envelopes (e.g., three) each being of longitudinal configuration including a major body portion having first and second longitudinally extending leg members. A transversely extending envelope portion joins the first and second leg members to form a continuous passage therethrough for an arc discharge. First and second minor transverse end portions are associated respectively with the first and second longitudinally extending leg members. A base member supports the plurality of sealed envelopes and has electrical contact means projecting from a surface of the base member. An ionizable medium is contained within each of the sealed envelopes. A pair of electrodes is spacedly located within each of the sealed envelopes for generating arc discharges therebetween and electrically coupled respectively to the electrical contact means. A phosphor layer is within each of the sealed envelopes and subtends at least the major body portion thereof. A non-specular light diffusing surface is associated with at least the first longitudinally extending leg member of each of the sealed envelopes and is axially located between the minor transverse end portion and one of the electrodes. The non-specular light diffusing surface extends in a direction transverse to an imaginary line parallel to the longitudinal axis. The surface brightness of the phosphor layer of each of the sealed envelopes as viewed through the minor transverse end portion of each of the sealed envelopes is of greater intensity than the external surface brightness of the phosphor layer subtending the major body portion of the sealed envelope respectively during operation.

BRIEF DESCRIPTION OF THE DRAWINGS

FIG. 1 is a front elevational cross-sectional view of an embodiment of an arc discharge lamp according to the invention showing a non-specular light diffusing surface located on a single constriction in each of the longitudinally extending leg members;

FIG. 2A is a cross-sectional view of the arc discharge lamp taken along the line 2A—2A in FIG. 1;

FIG. 2B is a cross-sectional view of the arc discharge lamp taken along the line 2B—2B in FIG. 1;

BEST MODE FOR CARRYING OUT THE INVENTION

Figure 3:
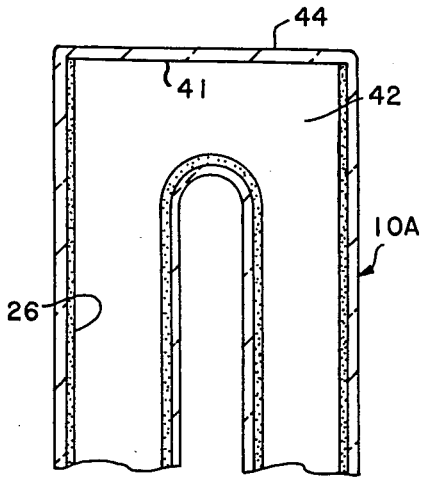
FIG. 3 is a partial front elevational view of an embodiment of an arc discharge lamp according to the invention showing the minor transverse end portion located on a flat surface of the transversely extending envelope portion.

For a better understanding of the present invention, together with other and further objects, advantages and capabilities thereof, reference is made to the following disclosure and appended claims taken in conjunction with the above-described drawings.

Referring now to the drawings with greater particularity to FIGS. 1, 2A and 2B, there is illustrated an arc discharge lamp 10, such as a fluorescent lamp, including a sealed envelope 12 containing an ionizable medium including a quantity of mercury and an inert starting gas at low pressure, for example, in the order of 1–5 mm of mercury. The starting gas can be, for example, argon, krypton, neon, or helium, or a mixture of these and other gases. A pair of electrodes 14, 16 supported by lead-in wires 18, 20 and 22, 24, respectively, is spacedly located within envelope 12 for generating an arc discharge therebetween during operation of lamp 10. Electrodes 14, 16 can be, for example, a double or triple-coiled tungsten filament of the usual type and carry a coating thereon which is usually in the form of carbonates which upon processing, are converted to oxide. Alternatively, one of the pair of electrodes may be in the form of an anode suitable for D.C. operation and requires only support from a single lead-in wire. A phosphor layer within sealed envelope 12 converts the ultraviolet radiation generated in the mercury discharge into visible radiation.

Envelope 12 of arc discharge lamp 10 in FIGS. 1 and 2A includes first and second longitudinally extending leg members 28 and 30, respectively. Also included with envelope 12 is a transversely extending envelope portion 32 joining the first and second longitudinally extending leg member 28 and 30 to form a continuous passage therethrough for the arc discharge. Transversely extending envelope portion 32 is longitudinally spaced a predetermined distance D (e.g., 0.375 inch) from an end portion of envelope 12. The transversely extending envelope portion may have various other shapes, for example, a squared U-shape configuration as illustrated by 42 in the partial front elevational view of the arc discharge lamp 10A of FIG. 3 or a rounded U-shape configuration as illustrated by 43 in the partial front elevational view of the arc discharge lamp 10B of FIG. 4.

In the embodiment shown in FIGS. 1 and 2A envelope 12 includes a major body portion 36 and first and second minor transverse end portions 38 and 40, respectively associated with first and second longitudinally extending leg members 28 and 30. A phosphor layer 26 is disposed on the internal surface 34 of major body portion 36 of envelope 12. Preferably, as illustrated in FIGS. 1 and 2A, substantially the entire internal circumference of leg members 28 and 30 is coated with phosphor layer 26. The phosphor layer is not disposed on the internal surface of at least a part of at least one of the minor transverse end portions. As best illustrated in FIGS. 1 and 2A, flat surface 41 on minor transverse end portions 38 and 40, which lies in a plane substantially perpendicular to the longitudinal axis of lamp 12, is devoid of phosphor. The minor transverse end portions may have a more curvilinear shape (See FIG. 4). According to the teachings of the present invention a non-specular (i.e., not having a shiny appearance) light diffusing surface within the envelope is axially located between a minor transverse end portion and one of the electrodes. The non-specular light diffusing surface extends in a direction transverse to an imaginary line parallel to the longitudinal axis of the lamp. The light diffusing surface is substantially opposite the internal surface of a minor transverse end portion and prevents a portion of the radiation from being lost through absorption at the the lamp ends containing the electrode structure.

In the embodiment of lamp 10 as best illustrated by FIGS. 1 and 2B, a non-specular light diffusing surface 37A, 37B is located on a constriction 39A, 39B, respectively. A single constriction 39A, 39B is formed in each of the longitudinally extending leg members 28, 30, respectively and extends 360 degrees about the circular periphery thereof. The transversely extending surfaces 37A, 37B projecting within the envelope are opposite the internal surface of minor transverse end portions 38, 40, respectively. The ratio of the maximum internal diameter MX to the minimum internal diameter MN is greater than about 2:1 (FIG. 2B). Preferably, the MX:MN is within the range of from about 2:1 to about 4:1.

The non-specular light diffusing surface which can be, for example, phosphor (as shown in FIGS. 1 and 2B), titanium dioxide, or aluminum oxide, further increases the surface brightness as viewed through the minor transverse end portion. In addition, the non-specular light diffusing surface in the present embodiment, allows viewing from a line of sight nearly perpendicular to the minor transverse end portion.

The internal surface brightness of the phosphor layer as viewed through the part of the minor transverse end portion devoid of phosphor can be five or six times greater than the intensity of the external surface brightness of the phosphor layer over the major body portion of the envelope during operation of the lamp. An envelope with a T6 (0.75 inch) outside diameter will result in a total area of increased surface brightness of approximately one square inch. The area of increased surface brightness can be varied by simply changing the diameter of the envelope.

Figure 4:
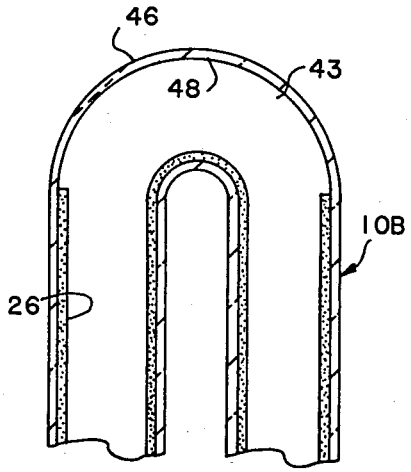
FIG. 4 is a partial front elevational view of another embodiment of an arc discharge lamp according to the invention showing the minor transverse end portion located on a U-shaped surface of the transversely extending envelope portion.

In the embodiments of FIGS. 3 and 4, the minor transverse end portion is located on the transversely extending envelope portion. In FIG. 3, minor transverse end portion 44 is located on the squared U-shaped transversely extending envelope portion 42. As illustrated, a flat surface 41 on end portion 44 is devoid of a phosphor layer. When viewed through the uncoated part of minor transverse end portion 44, the internal surface brightness of phosphor layer 26 is of greater intensity than the external surface brightness of phosphor layer 26 during lamp operation. In FIG. 4, minor transverse end portion 46 is located on the rounded U-shaped transversely extending envelope portion 43. As shown, a curvilinear U-shaped surface 48 on end portion 46 is devoid of a phosphor layer. Similarly during lamp operation, the internal surface brightness of phosphor layer 26 is of greater intensity than the external surface brightness of phosphor layer 6 when viewed through the uncoated part of minor transverse end portion 46.

Figure 5:
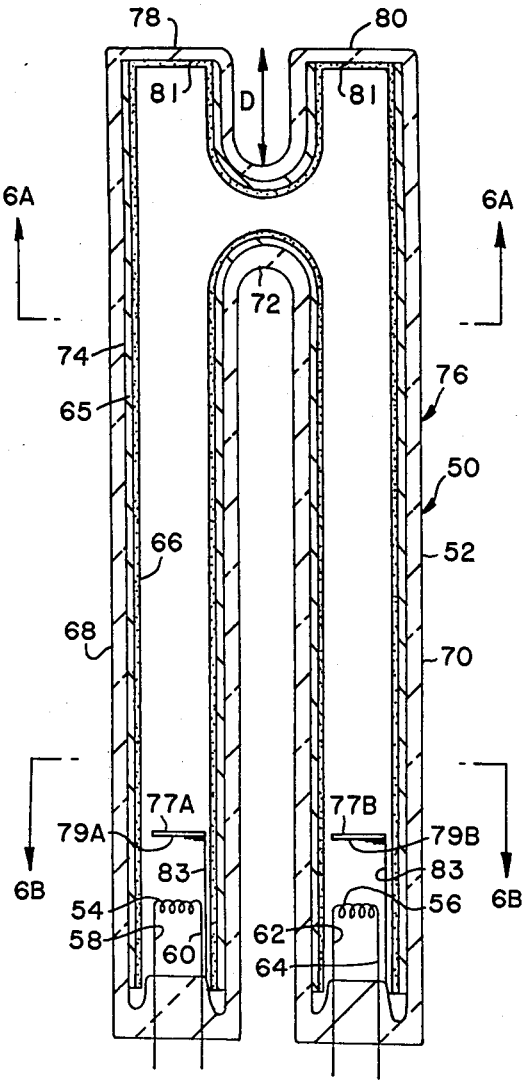
FIG. 5 is a front elevational cross-sectional view of another embodiment of an arc discharge lamp according to the invention showing the non-specular light diffusing surface located on a partition adjacent one of the electrodes in each of the longitudinally extending leg members.
Figure 6A:
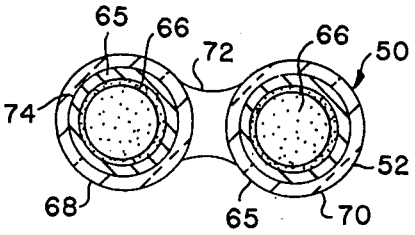
FIG. 6A is a cross-sectional view of the arc discharge lamp taken along the line 6A—6A in FIG. 5.
Figure 6B:
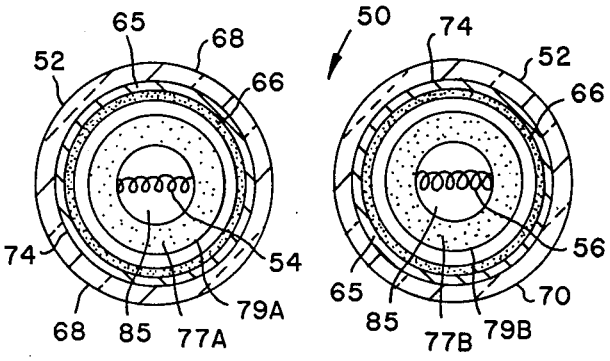
FIG. 6B is an exploded, cross-sectional view of the arc discharge lamp taken along the line 6B—6B in FIG. 5.

Reference is now made to FIGS. 5, 6A and 6B which show another embodiment of an arc discharge lamp according to the present invention. An arc discharge lamp 50, such as a fluorescent lamp, is shown including a sealed envelope 52 containing an ionizable medium including a quantity of mercury and an inert starting gas. A pair of electrodes 54, 56 supported by lead-in wires 58, 60 and 62, 64, respectively, is spacedly located within envelope 52 for generating an arc discharge therebetween during operation of lamp 50.

Envelope 52 includes first and second longitudinally extending leg members 68 and 70, respectively. Also included with envelope 52 is a transversely extending envelope portion 72 joining the first and second longitudinally extending leg members 68 and 70 to form a continuous passage therethrough for the arc discharge. Transversely extending envelope portion 72 is longitudinally spaced a predetermined distance D from an end portion of envelope 52. Envelope 52 includes a major body portion 76 and first and second minor transverse end portions 78 and 80, respectively associated with first and second longitudinally extending leg members 68 and 70.

To increase the surface brightness of lamp 50, a reflector layer 65 is disposed on the internal surface 74 of major body portion 76 of envelope 52. The reflector layer is not disposed on the internal surface of at least a part of at least one of the minor transverse end portions. In the embodiment illustrated in FIGS. 5 and 6, a part of each of the minor transverse end portions 78 and 80 is devoid of the internal reflector layer. Reflector layer 64 can be a non-absorbing material, such as, titanium dioxide or alumina. Thus the light which would normally be emitted out of the leg members would be reflected back into the lamp to further increase surface brightness.

A phosphor layer 66 is disposed on reflector layer 65 and, if desired, on a part of the internal surfaces of one or both of the minor transverse end portions. As shown in FIGS. 5, 6A and 6B, phosphor layer 66 is extended over the internal surfaces of both first and second minor transverse end portions 78 and 80. During lamp operation, the surface brightness of phosphor layer 66 as viewed through minor transverse end portions 78 and 80 of envelope 52 is of greater intensity than the external surface brightness of phosphor layer 66 on major body portion 76 of envelope 52. Preferably, as shown in FIGS. 5, 6A and 6B, substantially the entire internal circumference of leg members 68 and 70 is coated with reflector layer 65 overcoated with phosphor layer 66.

In the present embodiment, the non-specular diffusing surface 77A, 77B is located on an electrically isolated partition 79A, 79B adjacent an electrode 54, 56, respectively. The partition can be made of aluminum and have an aperture 85 formed therein for the arc discharge to pass therethrough or the partition can be a non-apertured disk with the discharge passing between the edge of the disk and the phosphored and reflectored wall (66, 74 and 52). The surface of the partition opposite a minor transverse end portion is coated with, for example, phosphor, titanium dioxide, or aluminum oxide. Partitions 79A, 79B are supported within the envelope by means of a lead wire 83 having one end thereof sealed in the press seal. Preferably, each partition lies in a plane substantially perpendicular to the longitudinal axis of the lamp.

In the embodiments described above, at least minor transverse end portions 38, 40, 44, 46, 78, 80 of each envelope are of light-transmitting vitreous material such as soda-lime or lead glass. Major body portions 36, 76 of first and second longitudinally extending leg members 28, 30 and 68, 70, respectively, can be made of a non-light-transmitting material, if desired.

Figure 7:
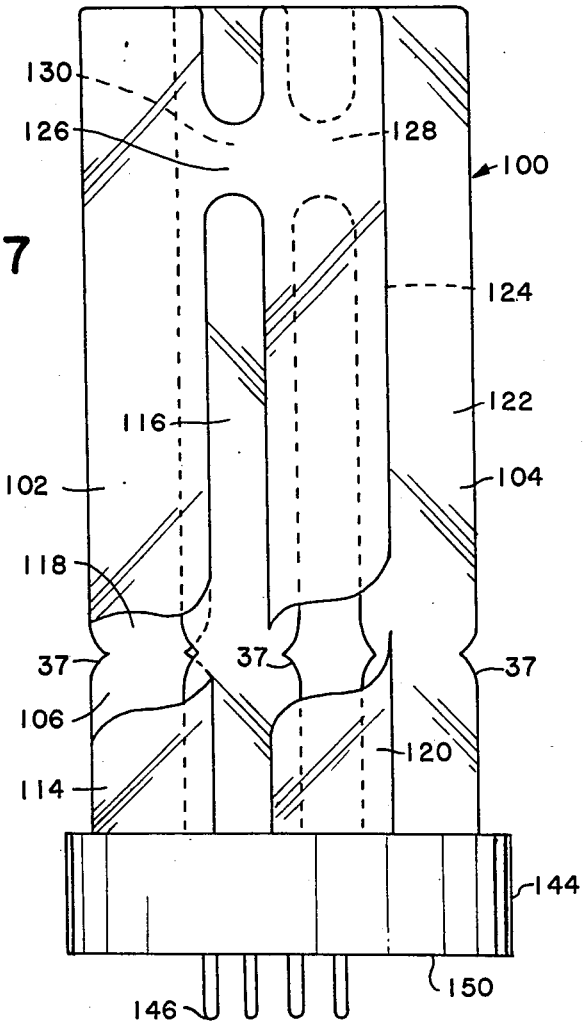
FIG. 7 is a front elevational view, partially broken away, of an embodiment of an arc discharge lamp array for use in a picture display according to the invention.
Figure 8:
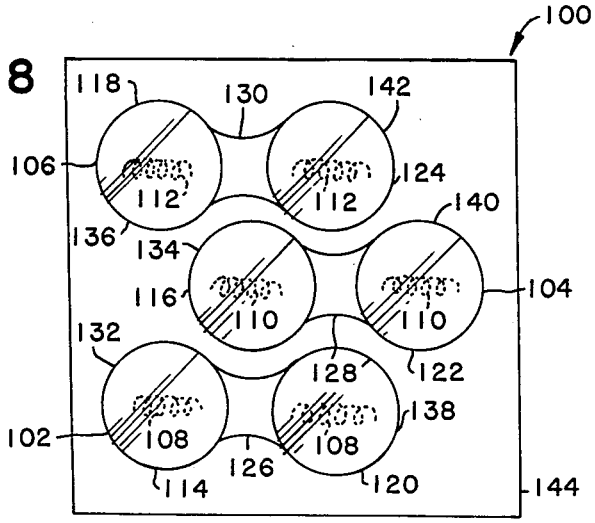
FIG. 8 is a plan view of the arc discharge lamp array shown in FIG. 7.

The arc discharge lamps described above can be used to form an arc discharge lamp array which can be used in a color picture display. In FIGS. 7 and 8, an arc discharge lamp array 100 is shown including three sealed envelopes 102, 104, 106. Each of the sealed envelopes includes a major body portion having respective first longitudinally extending leg members 114, 116, 118 and second longitudinally extending leg members 120, 122, 124. Each of the sealed envelopes 102, 104, 106 includes a transversely extending envelope portion 126, 128, 130, respectively, joining first and second pairs of leg members and first minor transverse end portions 132, 134, 136 and second minor transverse end portions 138, 140, 142 associated respectively with first longitudinally extending leg members 114, 116, 118 and second longitudinally extending leg members 120, 122, 124. Each of the sealed envelopes contains an ionizable medium having a quantity of mercury and an inert starting as a low pressure, for example, in the order of 1–5 mm of mercury. The starting gas and pressures in each of the three individually sealed envelopes may be different from each other. A pair of electrodes 108, 110 and 112 is spacedly located respectively within sealed envelopes 102, 104 and 106 for generating arc discharges between individual pairs of electrodes.

Sealed envelopes 102, 104, 106 can be made entirely of a light-transmitting vitreous material such as soda lime or lead glass. Alternatively, at least light producing minor transverse end portions 132, 134, 136, 138, 140, 142 is made of light-transmitting material and the remainder of the envelopes is made of a non-light-transmitting material.

A phosphor layer within each of the sealed envelopes subtends the major body portion of each of the envelopes by either being disposed on the internal surface of an envelope as shown in the first embodiment in FIGS. 1, 2A and 2B or on an underlying reflector layer as illustrated in the second embodiment in FIGS. 5, 6A and 6B. In the first embodiment, the phosphor layer does not subtend at least a part of the minor transverse end portions associated with the longitudinally extending leg members. In the second embodiment, the phosphor layer may also extend over the part of the internal surface of a minor transverse end portion not having the reflector layer thereon. For use in color picture display, the individually sealed envelopes 102, 104, 106 can be provided with respective fluorescent phosphor layers of different spectral power distributions emitting the different primary colors, i.e., red, green and blue such as YOX($Y_2O_3$:Eu), CAT($MgAl_{11}O_{19}$:Ce,Tb) and BAM($BaMg_2Al_{16}O_{22}$:Eu), respectively.

If each of the sealed envelopes is configured and coated as shown in FIGS. 1 and 5, a pair of colored elements or dots per envelope will be produced. At nominal viewing distances, the colored dots on the three separate envelopes will appear to form a single pixel to the unaided eye. It is understood that one colored dot per envelope can be produced, for example, if one of the internal surfaces 41 illustrated in FIG. 1 is also coated with phosphor layer 26 or if the reflector layer 65 in FIG. 5 is extended over one of the internal surfaces 81. A filter coating or externally mounted filter can be used to vary the color of the lamps.

A constriction 37 is formed in each of the longitudinally extending leg members in accordance with the present teachings.

Further included with arc discharge lamp array is a base member 144 supporting sealed envelopes 102, 104 and 106. Electrical contact means, such as pins 146, project from a surface 150 on base member 144 in order to provide connection from an electrical socket to the lamp electrodes.

While there have been shown and described what are at present considered to be the preferred embodiments of the invention, it will be apparent to those skilled in the art that various changes and modifications can be made herein without departing from the scope of the invention. For example, the lamps may have more than two leg members and more than one transversely extending envelope portion. Also, instead of an internal reflector layer or in addition thereto, an external non-absorbing reflector layer having a higher reflectivity than that of the internal reflector layer may be employed.

We claim:

1. An arc discharge lamp having a longitudinal axis comprising:

a sealed envelope having a longitudinal configuration and including a major body portion having at least first and second longitudinally extending leg members, first and second minor transverse end portions respectively associated with said first and second longitudinally extending leg members, and a transversely extending envelope portion joining said first and second leg members to form a continuous passage therethrough for an arc discharge;

an ionizable medium contained within said envelope;

a pair of electrodes spacedly located within said envelope for generating said arc discharge therebetween during operation of said lamp; and a phosphor layer disposed on the internal surface of said major body portion of said envelope and not disposed on the internal surface of said first and second minor transverse end portions of said envelope; and a non-specular light diffusing surface within said envelope associated respectively with each of said longitudinally extending leg members, said non-specular light diffusing surface axially located remote from said transversely extending envelope portion and between each minor transverse end portion and a respective electrode, said non-specular light diffusing surface extending in a direction transverse to an imaginary line parallel to said longitudinal axis such that the internal surface brightness of said non-specular light diffusing surface as viewed through said first and second minor transverse end portions of said envelope is of greater intensity than the external brightness of said phosphor layer on said major body portion of said envelope during operation of said lamp.

2. The arc discharge lamp of claim 1 wherein said non-specular light diffusing surface within said envelope is located on a constriction formed in said envelope and extending substantially about the circular periphery of said envelope and projecting therein.

3. The arc discharge lamp of claim 2 wherein the ratio of the maximum internal diameter of said envelope to the minimum internal diameter of said constriction is within the range of from about 2:1 to about 4:1.

4. The arc discharge lamp of claim 1 wherein said first and second longitudinally extending leg members each having a single constriction associated therewith whereon said non-specular light diffusing surface is located.

5. The arc discharge lamp of claim 1 wherein said non-specular light diffusing surface within said envelope is located on a partition adjacent said respective.

6. The arc discharge lamp of claim 5 wherein said partition lies in a plane substantially perpendicular to said longitudinal axis of said lamp.

7. The arc discharge lamp of claim 1 wherein said non-specular light diffusing surface comprises phosphor.

8. The arc discharge lamp of claim 1 wherein said non-specular light diffusing surface comprises titanium dioxide.

9. The arc discharge lamp of claim 1 wherein said non-specular light diffusing surface comprises aluminum oxide.

10. An arc discharge lamp having a longitudinal axis comprising:

a sealed envelope having a longitudinal configuration and including a major body portion having at least first and second longitudinally extending leg members, first and second minor transverse end portions respectively associated with said first and second longitudinally extending leg members, and a transversely extending envelope portion joining said first and second leg members to form a continuous passage therethrough for an arc discharge;

an ionizable medium contained within said envelope;

a pair of electrodes spacedly located within said envelope for generating said arc discharge therebetween during operation of said lamp;

a reflector layer disposed on the internal surface of said major body portion of said envelope and not disposed on the internal surface of said first and second minor transverse end portions of said envelope;

a phosphor layer disposed on said reflector layer; and a non-specular light diffusing surface within said envelope associated respectively with each of said longitudinally extending leg members, said non-specular light diffusing surface axially located remote from said transversely extending envelope portion and between each minor transverse end portion and a respective electrode, said non-specular light diffusing surface extending in a direction transverse to an imaginary line parallel to said longitudinal axis, the surface brightness of said phosphor layer as viewed through said first and second minor transverse end portions of said envelope is of greater intensity than the external surface brightness of said phosphor layer on said major body portion of said envelope during operation of said lamp.

11. The arc discharge lamp of claim 10 wherein said non-specular light diffusing surface within said envelope is located on a constriction formed in said envelope and extending substantially about the circular periphery of said envelope and projecting therein.

12. The arc discharge lamp of claim 11 wherein the ratio of the maximum internal diameter of said envelope to the minimum internal diameter of said constriction is within the range of from about 2:1 to about 4:1.

13. The arc discharge lamp of claim 14 wherein said first and second longitudinally extending leg members each having a single constriction associated therewith whereon said non-specular light diffusing surface is located.

14. The arc discharge lamp of claim 10 wherein said non-specular light diffusing surface within said envelope is located on a partition adjacent said one of said electrodes.

15. The arc discharge lamp of claim 14 wherein said partition lies in a plane substantially perpendicular to said longitudinal axis of said lamp.

16. An arc discharge lamp array comprising:

a plurality of sealed envelopes each being of longitudinal configuration including a major body portion having first and second longitudinally extending leg members, a transversely extending envelope portion joining said first and second leg members to form a continuous passage therethrough for an arc discharge, and first and second minor transverse end portions associated respectively with said first and second longitudinally extending leg members;

a base member supporting said plurality of sealed envelopes and having electrical contact means projecting from a surface of said base member;

an ionizable medium contained within each of said sealed envelopes;

a pair of electrodes spacedly located within each of said sealed envelopes for generating arc discharges therebetween and electrically coupled respectively to said electrical contact means;

a phosphor layer within each of said sealed envelopes and subtending at least said major body portion thereof;

a non-specular light diffusing surface associated with said first and second longitudinally extending leg members of each of said sealed envelopes axially located remote from said transversely extending envelope portion and between each minor transverse end portion and a respective electrode, said non-specular light diffusing surface extending in a direction transverse to an imaginary line parallel to said longitudinal axis, the surface brightness of said phosphor layer of each of said sealed envelopes as viewed through said first and second minor transverse end portions of each of said sealed envelopes is of greater intensity than the external surface brightness of said phosphor layer subtending said major body portion of said sealed envelope respectively during operation.

* * * * *